US007956300B2

(12) United States Patent
Hidaka et al.

(10) Patent No.: US 7,956,300 B2
(45) Date of Patent: Jun. 7, 2011

(54) SAFETY HOLDER

(75) Inventors: Takafumi Hidaka, Osaka (JP); Kiyo Hidaka, legal representative, Kunitomi-cho (JP); Norifumi Obata, Osaka (JP); Masaki Nobuhiro, Osaka (JP); Takeo Yasui, Osaka (JP); Masahiro Ishizaki, Osaka (JP)

(73) Assignee: Idec Corporation, Osaka-shi (JP)

( * ) Notice: Subject to any disclaimer, the term of this patent is extended or adjusted under 35 U.S.C. 154(b) by 335 days.

(21) Appl. No.: 12/065,827

(22) PCT Filed: Sep. 4, 2006

(86) PCT No.: PCT/JP2006/317475

§ 371 (c)(1),
(2), (4) Date: Nov. 10, 2008

(87) PCT Pub. No.: WO2007/029656

PCT Pub. Date: Mar. 15, 2007

(65) Prior Publication Data

US 2009/0321227 A1 Dec. 31, 2009

(30) Foreign Application Priority Data

Sep. 5, 2005 (JP) ..... 2005-256362

(51) Int. Cl.
*H01H 9/28* (2006.01)

(52) U.S. Cl. ..... 200/43.04; 200/43.11; 200/61.62; 200/334; 200/43.07

(58) Field of Classification Search ..... 200/43.04, 200/43.07, 43.11, 43.14–43.21, 61.62–61.66, 200/334; 70/14, 19, 30, 58
See application file for complete search history.

(56) References Cited

U.S. PATENT DOCUMENTS

| | | | | |
|---|---|---|---|---|
| 3,667,259 | A * | 6/1972 | Reque et al. | 70/14 |
| 5,365,757 | A * | 11/1994 | Primeau | 70/14 |
| 5,817,998 | A | 10/1998 | Siebels et al. | |

(Continued)

FOREIGN PATENT DOCUMENTS

| | | | |
|---|---|---|---|
| DE | 4029344 | A1 | 2/1991 |
| JP | 10-69831 | A | 3/1998 |
| JP | 11-509681 | A | 8/1999 |
| JP | 2004-353849 | A | 12/2004 |

OTHER PUBLICATIONS

International Search Report of PCT/JP2006/317475, date of mailing Oct. 3, 2006.

(Continued)

*Primary Examiner* — Michael A Friedhofer
(74) *Attorney, Agent, or Firm* — Westerman, Hattori, Daniels & Adrian, LLP

(57) ABSTRACT

A safety holder is provided that firmly attaches to a safety switch so that safety of a worker is enhanced. The safety holder includes a base body 21 that is inserted into an actuator insertion opening 7, and limits rotation of a drive cam 9 by engaging at a tip end portion (hanging portion 21C) thereof with a concave portion of the drive cam 9 of the safety switch, and a slide body that is movably attached to the base body 21 so as to be insertable into an actuator insertion opening 8 with the base body 21 inserted in the actuator insertion opening 7, and when the slide body is inserted into the actuator insertion opening 8, that enters and engages with an engagement hole 36 of the base body 21 whose tip end portion (insertion arm 34) is being inserted into the insertion opening 7.

15 Claims, 15 Drawing Sheets

U.S. PATENT DOCUMENTS 5,881,582 A * 3/1999 Monaco ..... 70/14
6,310,305 B1 * 10/2001 Kamino et al. ..... 200/43.11
6,755,450 B1 * 6/2004 Chen ..... 292/295
6,872,898 B2 * 3/2005 Mohtasham ..... 200/43.01
7,442,888 B2 * 10/2008 Puddicombe et al. ..... 200/43.04
7,456,368 B2 * 11/2008 Fukumoto et al. ..... 200/43.04
7,563,995 B2 * 7/2009 Jones ..... 200/43.04

OTHER PUBLICATIONS

European Search Report dated Mar. 3, 2009, issued in corresponding European Patent Application No. 06797398.

* cited by examiner

SAFETY HOLDER

TECHNICAL FIELD

The present invention relates to a safety holder attached to a safety switch that is attached to a wall surface of a doorway and the like of a room installed with industrial machines and stops power supply to the industrial machines or the like when the door of the doorway is open. More specifically, the present invention relates to a safety holder that is attached to a safety switch with a door of a doorway being opened and prevents rotation of a drive cam and insertion of an actuator in the safety switch.

BACKGROUND ART

Rooms and factories installed with industrial machines or dangerous zones around the industrial machines themselves require installation of systems for locking the machines when doors of the doorway of the room and dangerous zones are not completely closed, for the purpose of preventing occurrence of troubles such as worker injury caused by the worker being caught in the machines. In order to meet such a requirement, a safety switch (Japanese Unexamined Patent Application Publication No. 10-69831) has been proposed. The safety switch is configured as follows. A switch body of the safety switch is installed on wall surfaces in the vicinity of the doorway of the room. When the door of the doorway is closed, a dedicated actuator fixed to the door is inserted into an insertion opening of the switch body. The insertion leads to rotation of a drive cam in the switch body. An operating rod moves in response to the rotation of the drive cam so that the connection state of a contact point is switched. Such a switching operation of the contact point allows a circuit connection to be switched to a main circuit (a power supply circuit for the industrial machines) side so that the machines in the room become operable state.

However, such a safety switch has a following drawback. In the cases where a worker enters the room for maintenance or the like of the machines while keeping the machines stopped and where another worker, who does not know the fact that the maintenance is being carried out, closes the door, the machines could be started and the worker already in the room could fall into a dangerous situation.

Therefore, in order to prevent the occurrence of the above situation or the like and further to ensure safety of workers, the safety holder shown in FIG. 33 has been proposed. This safety holder 50 includes a base body 51 and a slide body 52 movably attached to the base body 51. How to use the safety holder 50 will be described below with reference to FIG. 34. Firstly, the base body 51 is inserted into an actuator insertion opening 54 of a switch body 53, whereby a protruding portion (not shown) provided on a lower surface of a tip end portion of the base body 51 engages with the actuator insertion opening 54. The slide body 52 is then moved along the base body 51 and inserted into the actuator insertion opening 54. At this time, the slide body 52 is maximally inserted all the way into the slot 54. This causes the slide body 52 to be fitted in the concave portion of a drive cam in the switch body 53 and prevents the drive cam from rotating. In this state, a lock mounting opening 55 formed in the base body 51 and a lock mounting opening 56 formed in the slide body 52 are overlapped each other, and a worker then locks each of the lock mounting openings 55 and 56 using padlocks 57, respectively. This blocks the actuator insertion opening 54, and prevents the rotation of the drive cam even though an actuator is inserted from the other actuator insertion openings 58.

Therefore, the machines are prevented from being actuated accidentally and safety of workers is ensured. This safety status is maintained until the padlocks are unlocked after completion of work, which ensures safety of workers.

Patent Reference 1: Japanese Unexamined Patent Application Publication No. 10-69831

DISCLOSURE OF THE INVENTION

Problem to be Solved by the Invention

However, the above-described prior art has the following problems.

(1) Both the base body 51 and the slide body 52 are merely inserted in the same one actuator insertion opening 54 and, therefore, the attaching state of the safety holder 50 with respect to the safety switch is not strong. Accordingly, there is a possibility that the safety holder 50 slips out from the actuator insertion opening 54 when the safety holder is pried open or the actuator is inserted in the other actuator insertion openings 58.

(2) In addition, since the lock mounting openings 55 and 56 in the base body 51 and the slide body 52 are arranged in alignment, a state occurs in which respective lock mounting openings 55 and 56 of the base body 51 and the slide body 52 overlap in the middle of insertion of the slide body 52 and before the slide body 52 being inserted all the way into the opening 54. Therefore, there is a possibility that the padlocks 57 are unintentionally locked in the lock mounting openings 55 and 56 in this state. In such a case, since the slide body 52 is not sufficiently inserted all the way, the attaching state of the safety holder 50 to the safety switch is not firm. Accordingly, when the actuator is inserted in the other actuator insertion opening 58, the driving cam rotates and the machine operates.

(3) Also, since both the base body 51 and the slide body 52 are inserted in the same one actuator insertion opening 54, the other actuator insertion opening 58 is not blocked. As a result, there is a possibility that the drive cam rotates when an actuator is forced to be inserted in the other actuator insertion opening 58.

As described above, the safety holder 50 of the prior art has not been adequate in view of safety of workers.

The present invention has been accomplished in view of the above-described circumstances, and it is an object of the present invention to provide a safety holder that blocks all of actuator insertion openings and firmly attaches to a safety switch, thereby enhancing safety of a worker.

Means for Solving the Problems

In order to achieve the above-described view, the invention provides a safety holder for preventing insertion of an actuator into a safety switch, the safety switch including a switch body having a box-shaped body and actuator insertion openings provided in two different surfaces thereof through which the actuator is insertable, and a contacting portion provided within the switch body, connection of which is switched in response to insertion of the actuator. The safety holder is characterized by comprising a base body that engages with one of the actuator insertion openings provided in the two different surfaces and blocks the one of the actuator insertion openings, and a slide body movably attached to the base body so as to be able to block, when the base body is engaged with the one of the actuator insertion openings, the other one of the actuator insertion openings provided in the two different surfaces by engaging with the other actuator insertion opening.

According to the above configuration, both one of the actuator insertion openings and the other actuator insertion opening are blocked. As such, by blocking all of the actuator insertion openings, the situation found in the prior art in which the safety holder is slipped out from the actuator insertion opening due to the actuator being unintentionally inserted, can be completely prevented from occurring. Consequently, a safety holder with enhanced worker safety can be realized.

In the meantime, it is sufficient in the present invention that the slide body is movable with respect to the base body, and the slide body may or may not be configured rotatably with respect to the base body.

In the present invention, a key hole that is formed by the base body and the slide body and for fixing the slide body may emerge only when the slide body is moved to a predetermined position at which the slide body blocks the other actuator insertion opening.

According to the above configuration, locking can be prevented when the slide body is in the middle of insertion, since the key hole does not emerge.

In the present invention, the slide body may be movably and rotatably attached to the base body, and the base body may be provided with a rotation limiting means for limiting rotation of the slide body when the slide body is pulled out.

As described above, since the rotation of the slide body is limited when the slide body is pulled out, there is an advantage that the safety holder is easy to use.

In addition, in the present invention, a tip end portion of the slide body may engage with a tip end portion of the base body engaging with the one of the actuator insertion openings when the slide body is engaged with the other actuator insertion opening.

According to the above configuration, since the tip end portion of the slide body engages with the tip end portion of the base body engaging with one of the actuator insertion openings with the slide body being engaged with the other actuator insertion opening, attaching state of the safety holder with respect to the safety switch body becomes much stronger comparing to an example of the prior art.

In addition, in the present invention, the tip end portion of the base body inserted into the one of the actuator insertion openings may be fitted into a concave portion of a drive cam provided within the switch body to thereby limit rotation of the drive cam.

As described above, by limiting the rotation of the drive cam, safety of the worker becomes further ensured.

Advantage of the Invention

According to the present invention, the following advantage may be obtained.

Both the one of actuator insertion openings and the other actuator insertion opening are blocked. By blocking all of the actuator insertion openings like this, the situation found in the prior art, in which the safety holder is slipped out from the actuator insertion openings due to the actuator being unintentionally inserted, can be completely prevented from occurring. As a result of this, a safety holder with safety of a worker being enhanced is realized.

BEST MODE FOR CARRYING OUT THE INVENTION

Hereinafter, a safety holder according to the present invention will be described in detail by way of embodiments. However, the present invention is not limited to the following embodiments.

Now, general configuration of a safety switch for which a safety holder of the present invention is used will be described with reference to FIG. 1 through FIG. 5. As shown in FIG. 1, a safety switch 1 is a switch electrically connected to industrial machines installed in a room. The switch is mainly constituted with a switch body 2 and an actuator 3. The switch body 2 is firmly fixed to a wall surface in the periphery of a doorway of a room, and the actuator 3 is firmly fixed to a door 4.

The switch body 2 is constituted with an operating portion 5 in which the actuator 3 is inserted and a switch portion 6 in which a contact block (not shown) is embedded. The operating portion 5 is provided with actuator insertion openings 7 and 8 on its two different surfaces such that the insertion direction of the actuator can be selected according to the condition of an installation location. The operating portion 5 is also provided with a drive cam 9 as apparently shown in FIG. 4. The drive cam 9 gives displacement to an operating rod 10 of the contact block (not shown) embedded in the switch portion 6 and is rotatably supported by a cam shaft 11. Rectangular concave portions 12 and 13 are formed on the periphery surface of the drive cam 9 corresponding to the actuator insertion openings 7 and 8.

In the safety switch configured as above, when the actuator 3 proceeds to the inside of the operating portion 5 through the actuator insertion opening 7 and a pressing piece 3*a* of the actuator 3 (refer to FIG. 1A) hits the drive cam 9, the drive cam 9 rotates. In response to the rotation of this drive cam 9, the operating rod 10 of the switch portion 6 moves to the side of the drive cam 9 of the operating portion 5. Then, when the actuator 3 proceeds to an insertion edge, a connection contact point of the contact block is switched so that the machines in the room are brought into a drivable state. At the same time, the pressing piece 3*a* of the actuator 3 fits into the concave portion 12 of the drive cam 9 (refer to FIG. 4).

Next, when the actuator 3 is pulled out from this state, the drive cam 9 rotates in the direction opposite to the aforementioned direction due to backward movement of the actuator 3. In response to the rotation, the operating rod 10 moves to the connection contact point side of the switch portion 6. Then the connection contact point is switched to turn off the power supply to the machines.

In another embodiment, when the actuator 3 proceeds to the inside of the operating portion 5 through the other actuator insertion opening 8, the pressing piece 3*a* of the actuator 3 hits the drive cam 9 to rotate the drive cam 9. In response to the rotation of this drive cam 9, the operating rod 10 of the switch portion 6 moves to the side of the drive cam 9 of the operating portion 5 and the connection contact point is switched. At the same time, the pressing piece 3*a* of the actuator 3 fits into the concave portion 13 of the drive cam 9 (refer to FIG. 4). When the actuator 3 is pulled out from this state, the drive cam 9 rotates in the opposite direction, and then the operating rod 10 moves to the connection contact point side of the switch portion 6 so that the connection contact point is switched.

In the safety switch configured as above, when a worker enters the room for maintenance or the like of machines, the stopped state of the machines is maintained as long as the door 4 is kept opened. Therefore, safety of the worker is ensured. However, when the door 4 is closed by mistake, the machines are started, and the worker in the room could fall into a dangerous situation. To prevent such an accident from being occurred and ensure safety of a worker, the safety holder according to the present invention is used.

FIG. 6 is a plan view of the safety holder where a slide body that is a component of the safety holder of the present invention is not inserted. FIG. 7 is a side view of the safety holder where a slide body that is a component of the safety holder of the present invention is not inserted. FIG. 8 is a bottom plan view of the safety holder where a slide body that is a component of the safety holder of the present invention is not inserted. FIG. 9 is a cross sectional view taken along line C-C of FIG. 6. FIG. 10 is a plan view of the safety holder where a slide body that is a component of the safety holder of the present invention is inserted. FIG. 11 is a side view of the safety holder where a slide body that is a component of the safety holder of the present invention is inserted. FIG. 12 is a bottom plan view of the safety holder where a slide body that is a component of the safety holder of the present invention is inserted; and FIG. 13 is a cross sectional view taken along line D-D of FIG. 10.

A safety holder 20 is constituted with a base body 21 and a slide body 22. The base body 21 and the slide body 22 are, for example, plate shaped members made of metal. Also, the base body 21 and the slide body 22 may be members made of rigid synthetic resin. The slide body 22 is formed with a guide opening 23 extending in a longitudinal direction (corresponding to insertion direction X shown in FIG. 23 and FIG. 25). A connecting shaft 25 is inserted through the guide opening 23 and a shaft opening 24 (refer to FIG. 14) in the base body 21 so as to be riveted. This allows the slide body 22 to be movable in a longitudinal direction (corresponding to the insertion direction X) with respect to the base body 21, and to be rotatable around the connecting shaft 25. In the meantime, it is sufficient for the safety holder according to the present invention that the slide body 22 is attached movably in a longitudinal direction (corresponding to the insertion direction X) with respect to the base body 21, and it is not necessary that the slide body 22 is rotatable with respect to the base body 21. However, in this embodiment, the configuration where the slide body 22 is movable with respect to the base body 21 is realized by a simple configuration in which the slide body 22 and the base body 21 are riveted by the connecting shaft 25 through the guide opening 23. As a result, the slide body 22 becomes rotatable and movable with respect to the base body 21.

FIG. 14 is a plan view of a base body. FIG. 15 is a side view of the base body. FIG. 16 is a bottom plan view of the base body. FIG. 17 is a cross sectional view taken along line E-E of FIG. 14. FIG. 18 is a plan view of the slide body. FIG. 19 is a side view of the slide body. FIG. 20 is a bottom plan view of the slide body; and FIG. 21 is a cross sectional view taken along line F-F of FIG. 18. In addition to these FIGS. 14 through 18, FIGS. 6 through 13 are also referred to, to explain the configurations of the base body 21 and the slide body 22 in detail.

As shown in FIGS. 14 through 17, the base body 21 includes a first flat portion 21*a*, an elevating portion 21*b* vertically elevating at a tip end portion of the first flat portion 21*a*, a second flat portion 21*c* continuing to the elevating portion 21*b* and parallel to the first main body portion 21*a*, and a hanging portion 21*d* vertically descending at a tip end portion of the second flat portion 21*c*. The first flat portion 21*a* is formed with a pair of circular lock mounting openings 30*a* and 30*b*, and a lock mounting opening 30*c* of an oval shape elongating in the width direction (vertical direction of FIG. 14). The lock mounting openings 31*a* and 30*b* are located nearer the tip end portion (nearer to the elevating portion 21*b*), and formed with space therebetween in the width direction. The lock mounting opening 30*c* is located nearer to the rear end section (nearer to the right end section side of FIG. 14). An ark shaped portion 31A of the lock mounting opening 30*c* is located more internally than a half arc shaped portion 32A of the lock mounting opening 30*a* (lower side of the half arc shaped portion in FIG. 14), and an ark shaped portion 31B of the lock mounting opening 30*c* is located more internally than a half arc shaped portion 32B of the lock mounting opening 30*b* (upper side of the half arc shaped portion in FIG. 14). That is, the lock mounting openings 30*a* and 30*b* and the lock mounting opening 30*c* are arranged to be deviated each other in the width direction (corresponding to the direction perpendicular to the insertion direction X).

The elevating portion 21*b* is formed with an opening 35 through which insertion arms 34 (refer to FIG. 18) of the slide body is inserted. Further, the hanging portion 21*d* serves to limit the rotation of the drive cam 9 by proceeding in the below-described actuator insertion opening 8 and engaging with the concave portion 12 of the drive cam 9. This hanging portion 21*d* is formed with an engagement hole 36 in which the engaging state can be obtained by insertion of the insertion arms 34 of the slide body 22.

On the other hand, as shown in FIGS. 18 and 20, the slide body 22 is constituted with a main body portion 22*a* and a knob portion 22*b*. The knob portion 22 can be provided to the base body 21. The main body portion 22*a* is formed with the guide opening 23, as well as the two insertion arms 34 at the forward section extending in the longitudinal direction with elongated notches 37. In this embodiment, a portion corresponding to the pressing piece 3*a* of the actuator 3 does not exist at the tip end portion of the main body portion 22*a*. Therefore, the insertion arms 34 inserted from the actuator insertion opening 8 of the safety switch only pass through the side of the drive cam 9, and do not push the drive cam 9. As a result, the drive cam 9 does not rotate. In addition, the main body portion 22*a* is formed with a pair of circular lock mounting openings 40*a* and 40*b* on both sides of the guide opening 23. Also, one lock mounting opening 40*c* of an oval shape elongating in the width direction (vertical direction of FIG. 18) is formed on the rear side of the guide opening 23 (right side in FIG. 18). These lock mounting openings 40*a*, 40*b*, and 40*c* correspond to the aforementioned lock mounting openings 30*a*, 30*b*, and 30*c*, respectively. In the state where the slide body 22 is inserted and the insertion arms 34 engage with the engagement hole 36 of the base body 21, the lock mounting opening 30*a* exactly overlaps with the lock mounting opening 40*a*, the lock mounting opening 30*b* exactly overlaps with the lock mounting opening 40*b*, and the lock mounting opening 30*c* with the lock mounting opening 40*c* as shown in FIG. 10. Thus the padlocks 45 (refer to FIG. 27 and FIG. 29) can be locked.

Furthermore, the relative location between the lock mounting openings 40*a* and 40*b* and the lock mounting opening 40*c* is similar to that between the lock mounting openings 30*a* and 30*b* and the lock mounting opening 40*c* described above, and the lock mounting openings 40*a* and 40*b* and the lock mounting opening 40*c* deviate each other in the width direction (corresponding to the direction perpendicular to the insertion direction X). Accordingly, in the middle of insertion of the slide body 22, only part of the lock mounting opening 30*a* and the lock mounting opening 40*c* overlap, and also only part of the lock mounting opening 30*b* and the lock mounting opening 40*c* overlap. As the result, the padlock 45 cannot be locked via the lock mounting opening 30*a* and the lock mounting opening 40*c*, and also the padlock 45 cannot be locked via the lock mounting opening 30*b* and the lock mounting opening 40*c*.

In this example, the lock mounting openings 30*c* and 40*c* are oval; however, they may be circular lock mounting openings like the lock mounting openings 30*a* and 30*b*, and 40*a* and 40*b*. However, such a case also requires that the locations of lock mounting openings are deviated from the lock mounting openings 30*a* and 30*b*, 40*a* and 40*b*. That is, it is required that, when a plurality of lock mounting openings are provided along the insertion direction X, respective lock mounting openings are not arranged in alignment but are deviated in the direction perpendicular to the insertion direction X (width direction). This allows the lock of the padlocks through wrong openings to be prevented.

Furthermore, the insertion arms 34 of the slide body 22 is inserted in the opening 35 of the base body 21 and the tip end portion of the insertion arms 34 is kept inserted in the opening 35, as shown in FIG. 22, even after the slide body 22 being pulled out from the actuator 8. Therefore, the rotation of the tip end portion of the insertion arms 34 is limited by inner walls of both sides of the opening 35. Therefore, it is not required to insert the insertion arms 34 into the opening 35 when the safety holder 20 is used again, which provides the advantage of being user-friendly.

FIG. 23 is a side view showing a state where the base body of the safety holder is mounted to the safety switch. FIG. 24 is a plan view showing a state where the base body of the safety holder is mounted to the safety switch. FIG. 25 is a longitudinal cross-sectional view of FIG. 23. FIG. 26 is a side view showing a state where the slide body of the safety holder is inserted in the safety switch. FIG. 27 is a plan view showing a state where the slide body of the safety holder is inserted in the safety switch. FIG. 28 is a longitudinal cross-sectional view of FIG. 26; and FIG. 29 is a transverse cross-sectional view of FIG. 26.

How to use the safety holder 20 having the above-described configuration will be described with reference to these drawings.

Firstly, as shown in FIGS. 23 through 25, the slide body 22 is made to face the actuator insertion opening 8, and the hanging portion 21*d* of the base body 21 is inserted into the actuator insertion opening 7. Due to this operation, the hanging portion 21*d* is fitted in the concave portion 12 of the drive cam 9 and the rotation of the drive cam 9 is limited. Then, the slide body 22 is pushed into along the insertion direction X while holding the knob portion 22*b*. Therefore, the insertion arms 34 are inserted into the actuator insertion opening 8. Next, the slide body 22 is maximally pushed all the way inside and, as shown in FIGS. 26 through 29, the insertion arms 34 pass through both sides of the drive cam 9, the distal end portion thereof enters the engagement hole 36 of the hanging portion 21*c* to thereby be able to obtain an engaging state (refer to FIG. 28 and FIG. 29). This results in that the safety holder 20 is firmly fixed to the switch body 3.

In such a state in which the insertion arms 34 enter the engagement hole 36 of the hanging portion 21*d*, the lock mounting opening 30*a* and the lock mounting opening 40*a*, the lock mounting opening 30*b* and the lock mounting opening 40*b*, and the lock mounting opening 30*c* and the lock mounting opening 40*c* are exactly overlapped, respectively. Therefore, a key hole 100 for fixing the slide body 22 with respect to the base body 21 is configured (refer to FIG. 27 and FIG. 29). Therefore, it becomes possible to lock the padlock 45 through the key hole 100. A worker, therefore, locks each of the lock mounting openings 30*a* and 40*a* (key hole 100); 30*b* and 40*b* (key hole 100); and 30*c* and 40*c* (key hole 100) using the padlocks 45, respectively. After completion of work, the worker releases each of the padlocks 45. Therefore, since the state in which the safety holder 20 is fixed in the safety switch is maintained until the last padlock 45 is released, safety of the worker is ensured.

As described above, since the safety holder 20 of the above configuration blocks the actuator insertion openings 7 and 8, the situation in which the drive cam 9 is rotated due to insertion of the actuator can be completely prevented from occurring. Also, since the engaging state can be obtained when the insertion arms 34 enter the engagement hole of the hanging portion 21*d*, the attaching state of the safety holder with respect to the safety switch body becomes much stronger than that of the safety holder of the prior art.

Other Embodiments (1) In the above embodiment, the slide body 22 is movable in insertion direction X with respect to the base body 21, and rotatable around the connecting shaft 25. However, the configuration may be such that the slide body 22 is movable in the insertion direction X, but not rotatable.

(2) In the above embodiment, the configuration is such that the insertion arms 34 enter the engagement hole 36 and the attaching state can be obtained. However, notches into which the insertion arms 34 are fixed may be used in place of the engagement hole.

(3) In the above embodiment, a padlock is exemplified as a lock; however, a latch, pin, and so forth can be used instead of a padlock. In short, anything can be used as long as it can limit the movement of the slide body by connecting the base body and the slide body.

(4) In the above embodiment, one actuator insertion opening 7 is provided in the upper surface of the switch body 3. However, the safety holder of the present invention can be applied to a safety switch having a configuration in which an actuator insertion opening for rotating the drive cam 9 in the opposite direction is disposed on front side of the actuator insertion opening 7. In the safety switch having such a configuration, an effect of blocking all of the actuator insertion openings can be obtained, because, when the hanging portion 21*d* of the base body 21 is inserted in the actuator insertion opening 7, the second flat portion 21*c* of the base body 21 covers the actuator insertion opening for rotating in the opposite direction.

(5) In the above embodiment, in order to lock the padlock 45 (FIG. 27 and FIG. 29), both the base body 21 and the slide body 22 are formed with the lock mounting openings, and the key hole 100 for fixing the slide body 22 is formed when both the base body 21 and the slide body 22 exactly overlap each other. However, as shown in FIG. 30, it may be possible to form a lock mounting opening 47 to the base body 21 and opening lock mounting notches 48 to the slide body 22 side. On the contrary, as shown FIG. 31, the lock mounting notches 48 may be formed to the base body 21 and the lock mounting opening 47 may be formed to the slide body 22. Meanwhile, each of the lock mounting openings can be independent. However, as shown in FIG. 32, it can be possible to have a configuration that the adjacent lock mounting openings 47 are communicated with each other to form a single lock mounting opening 47A. As described above, any configuration can be acceptable as long as a key hole that is formed by the base body and slide body and serves to fix the slide body, emerges only when the slide body moves to a predetermined position to block the actuator insertion opening.

The present invention can be suitably implemented on a safety holder of a safety switch.

DESCRIPTION OF REFERENCE NUMERALS

Figure 1A:
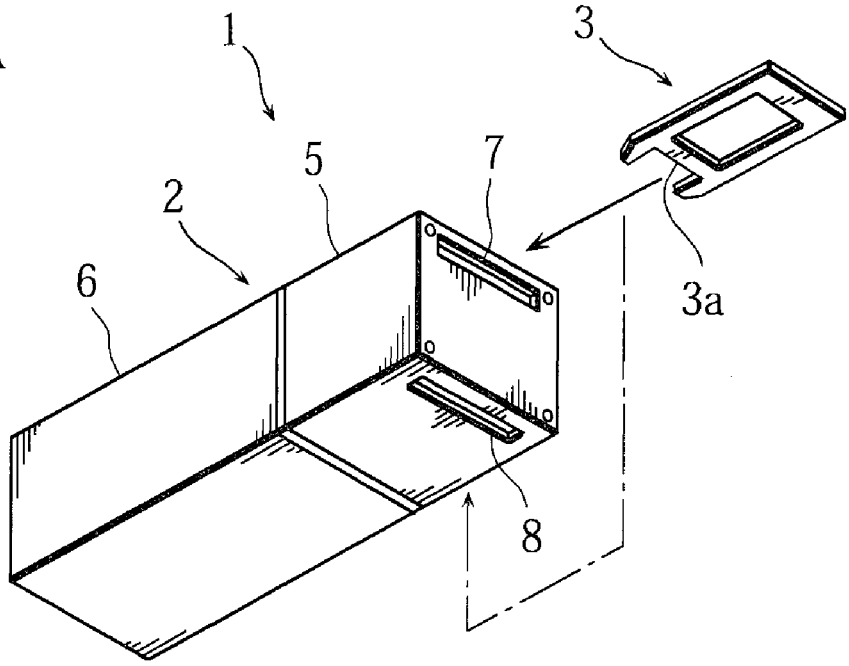
FIGS. 1A and 1B are a view showing a using state of a safety switch in which a safety holder according to the present invention is used.
Figure 1B:
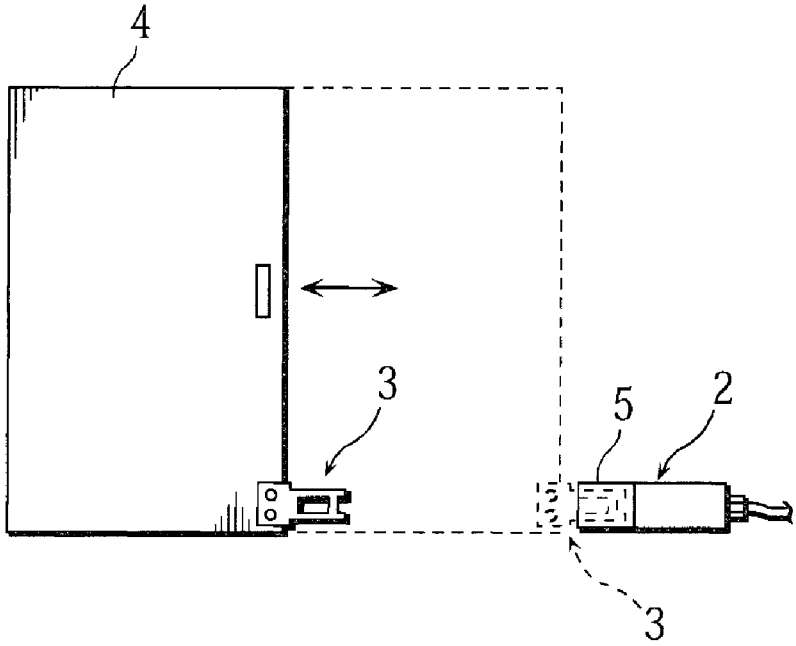
Figure 2:
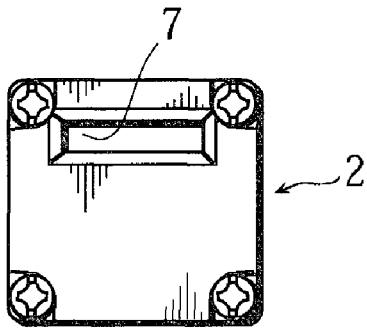
FIG. 2 is a plan view of the safety switch in which the safety holder according to the present invention is used.
Figure 3:
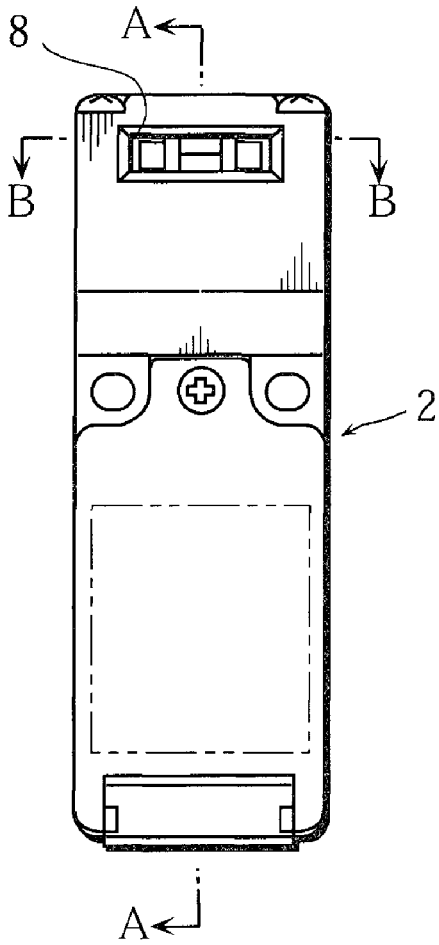
FIG. 3 is a front view of the safety switch in which the safety holder according to the present invention is used.
Figure 4:
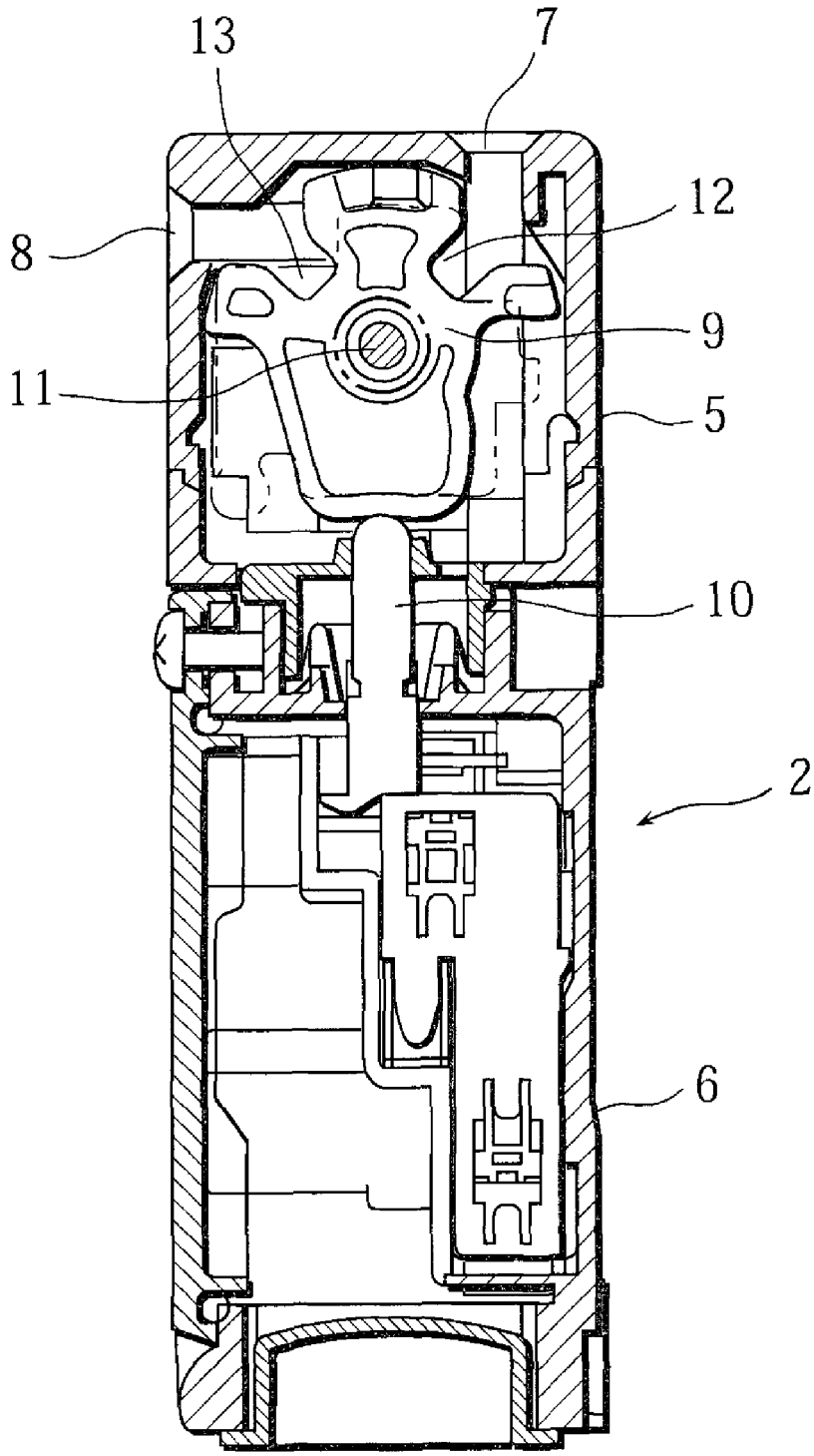
FIG. 4 is a cross sectional view taken along line A-A of FIG. 3.
Figure 5:
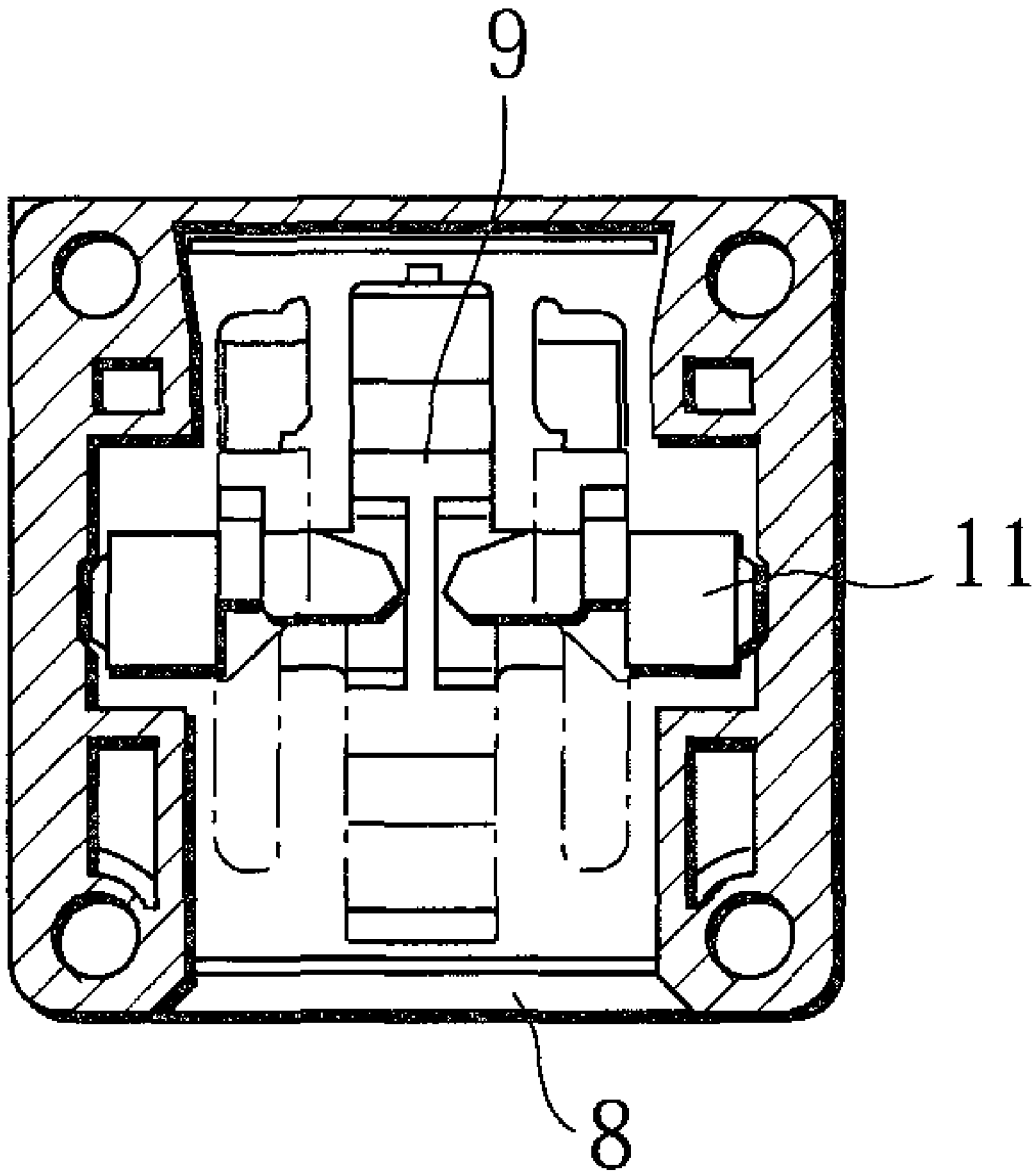
FIG. 5 is a cross sectional view taken along line B-B of FIG. 3.
Figure 6:
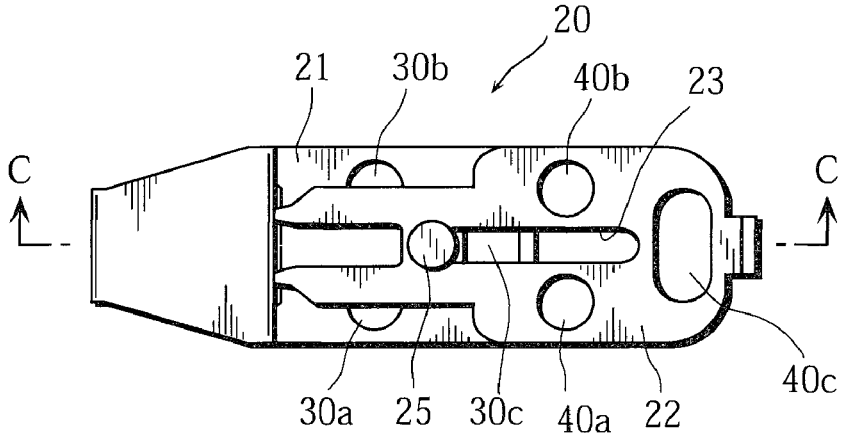
FIG. 6 is a plan view of the safety holder where a slide body that is a component of the safety holder of the present invention is not inserted.
Figure 7:
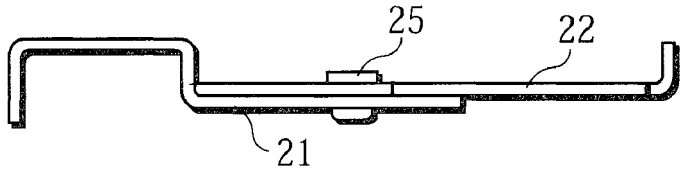
FIG. 7 is a side view of the safety holder where a slide body that is a component of the safety holder of the present invention is not inserted.
Figure 8:
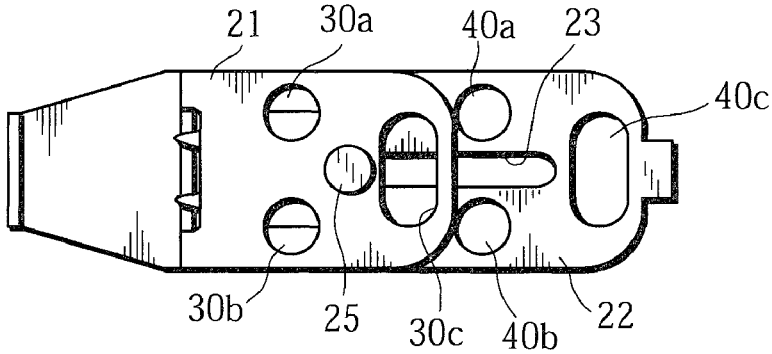
FIG. 8 is a bottom plan view of the safety holder where a slide body that is a component of the safety holder of the present invention is not inserted.
Figure 9:
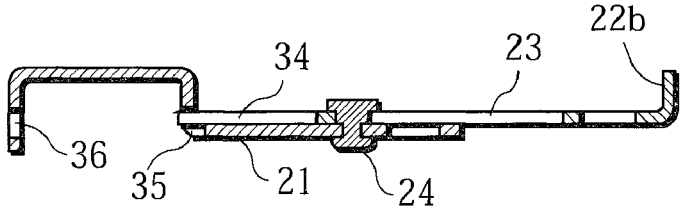
FIG. 9 is a cross sectional view taken along line C-C of FIG. 6.
Figure 10:
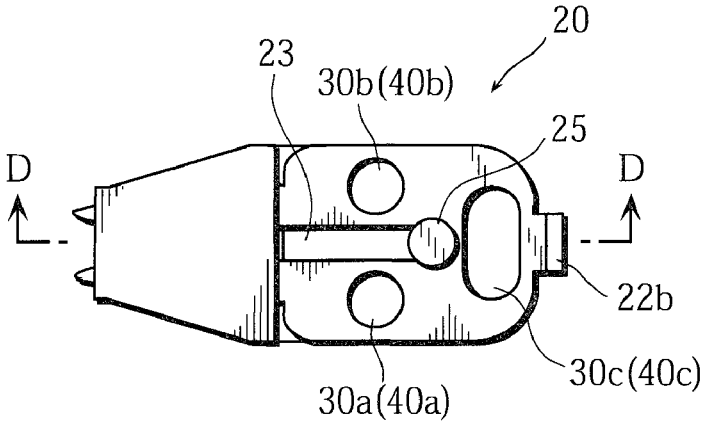
FIG. 10 is a plan view of the safety holder where a slide body that is a component of the safety holder of the present invention is inserted.
Figure 11:
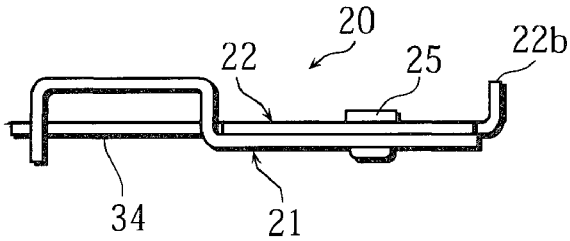
FIG. 11 is a side view of the safety holder where a slide body that is a component of the safety holder of the present invention is inserted.
Figure 12:
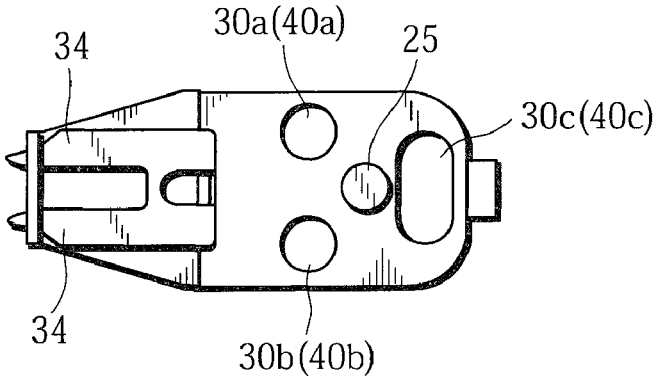
FIG. 12 is a bottom plan view of the safety holder where a slide body that is a component of the safety holder of the present invention is inserted.
Figure 13:
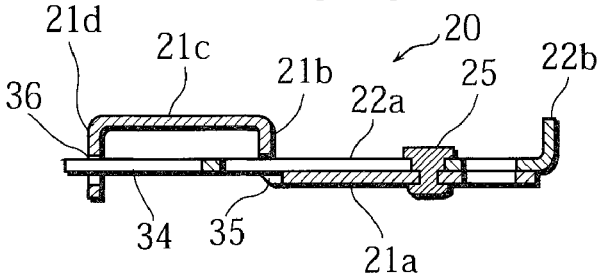
FIG. 13 is a cross sectional view taken along line D-D of FIG. 10.
Figure 14:
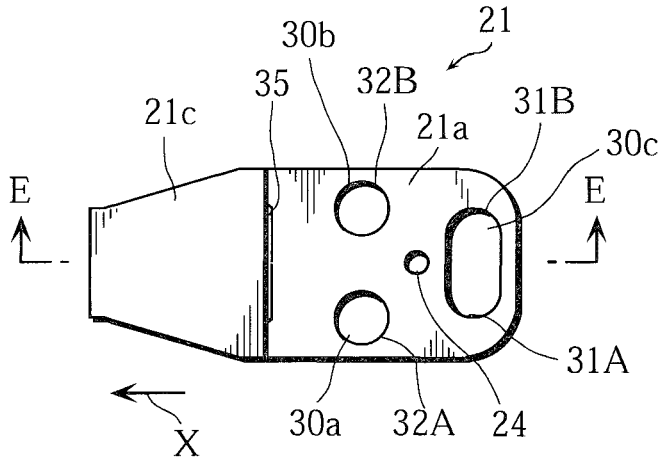
FIG. 14 is a plan view of a base body.
Figure 15:
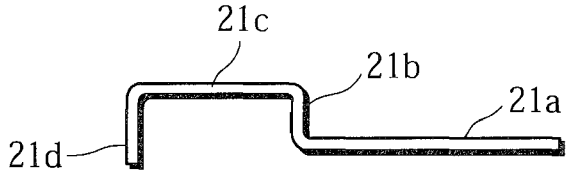
FIG. 15 is a side view of the base body.
Figure 16:
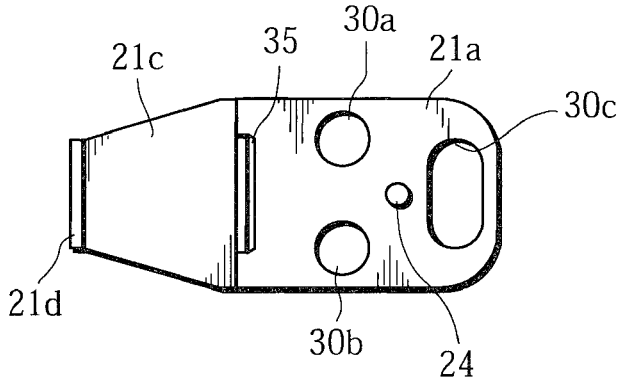
FIG. 16 is a bottom plan view of the base body.
Figure 17:
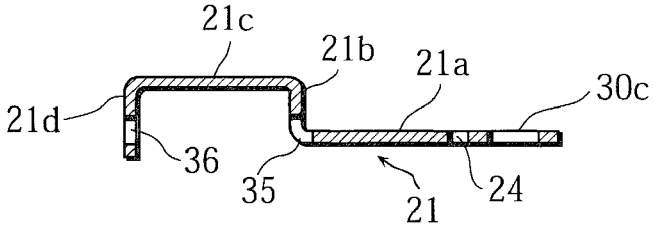
FIG. 17 is a cross sectional view taken along line E-E of FIG. 14.
Figure 18:
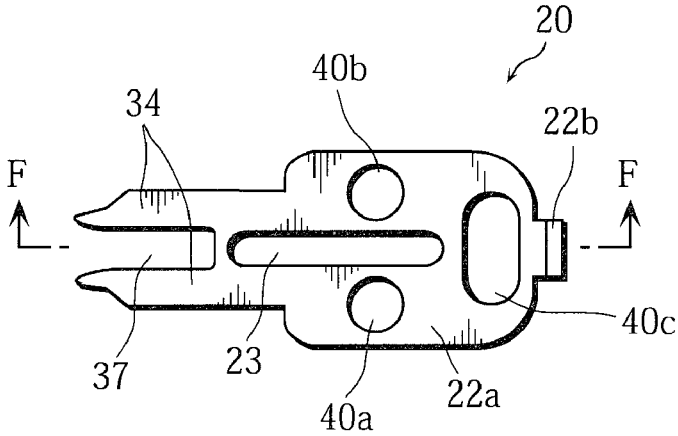
FIG. 18 is a plan view of a slide body.
Figure 19:
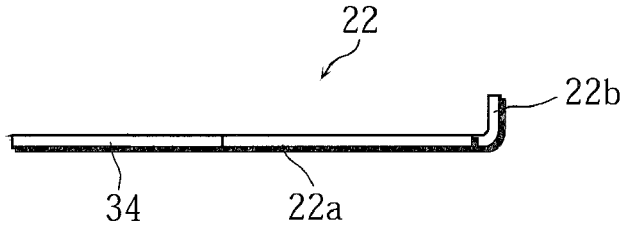
FIG. 19 is a side view of the slide body.
Figure 20:
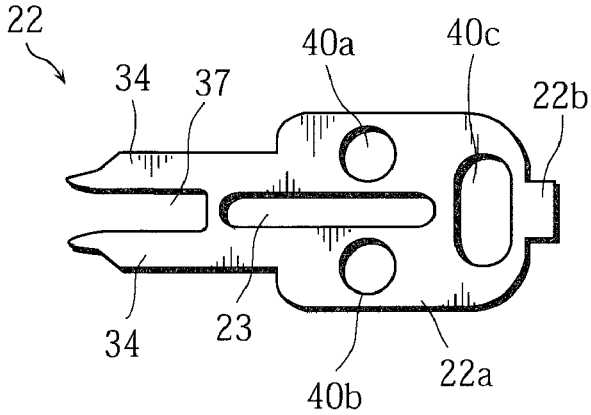
FIG. 20 is a bottom plan view of the slide body.
Figure 21:
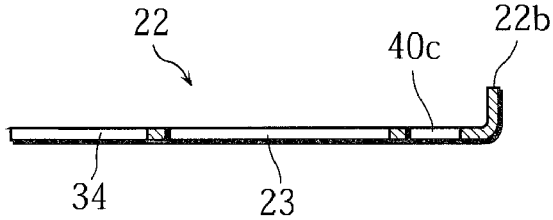
FIG. 21 is a cross sectional view taken along line F-F of FIG. 18.
Figure 22:
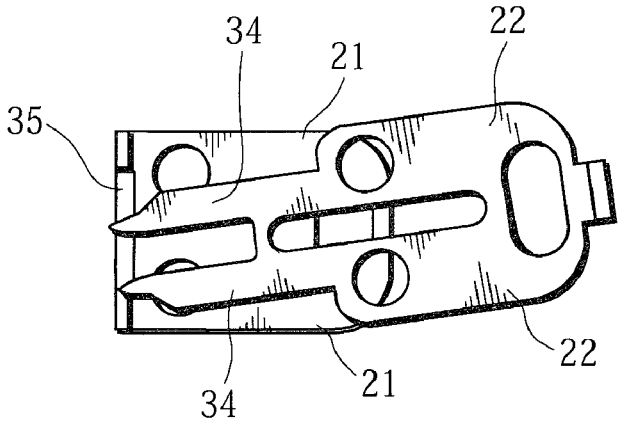
FIG. 22 is a plan view showing a state in the vicinity of the tip end of an insertion arm with the slide body being maximally pulled out.
Figure 23:
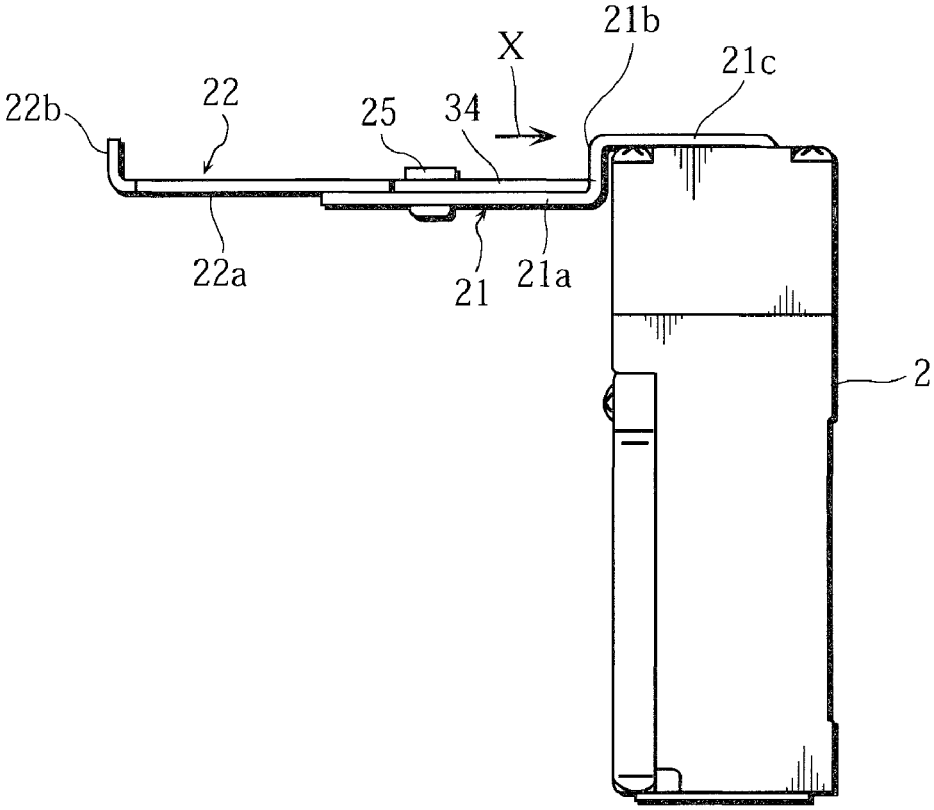
FIG. 23 is a side view showing a state where the base body of the safety holder is mounted to the safety switch.
Figure 24:
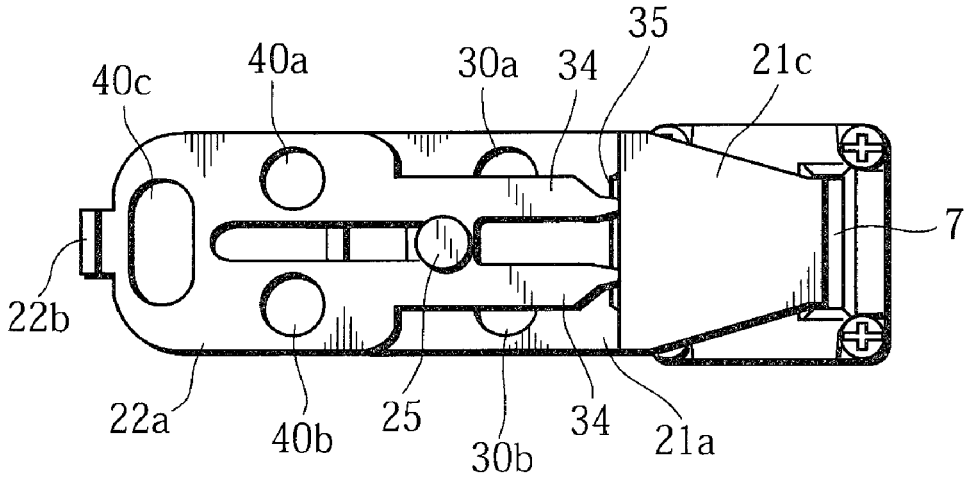
FIG. 24 is a plan view showing a state where the base body of the safety holder is mounted to the safety switch.
Figure 25:
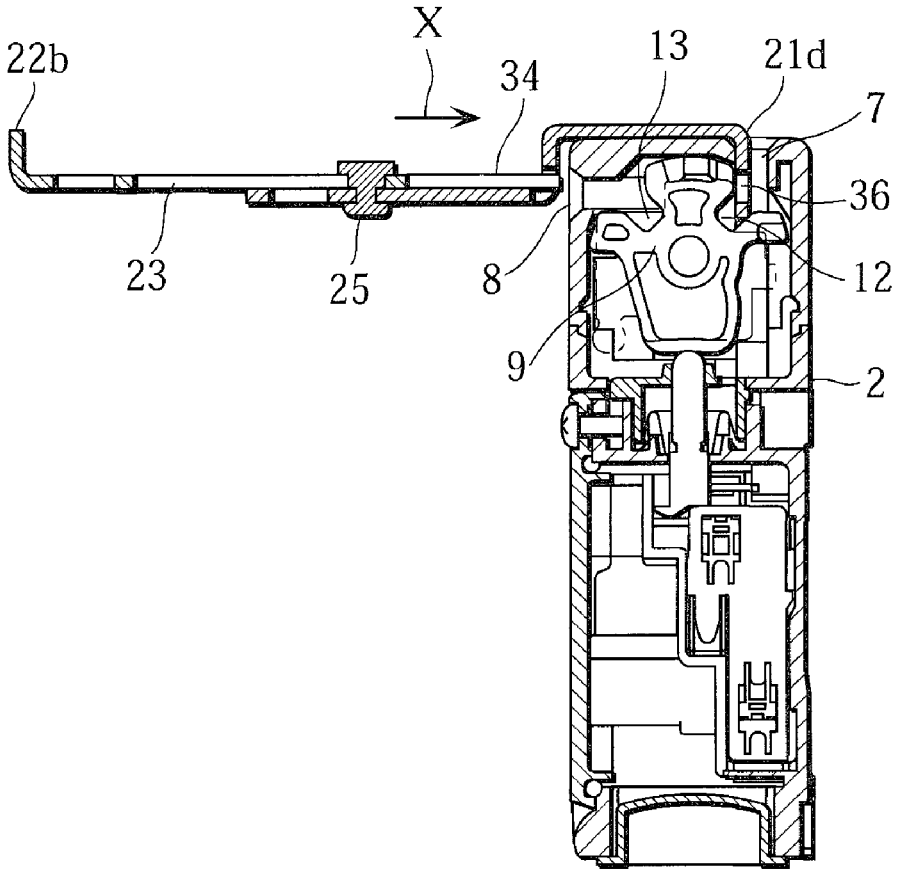
FIG. 25 is a longitudinal cross-sectional view of FIG. 23.
Figure 26:
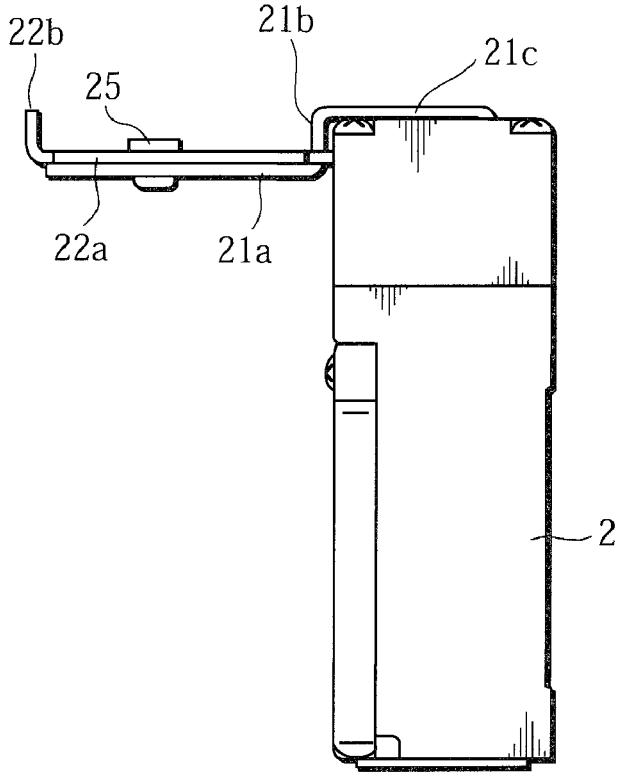
FIG. 26 is a side view showing a state where the slide body of the safety holder is inserted in the safety switch.
Figure 27:
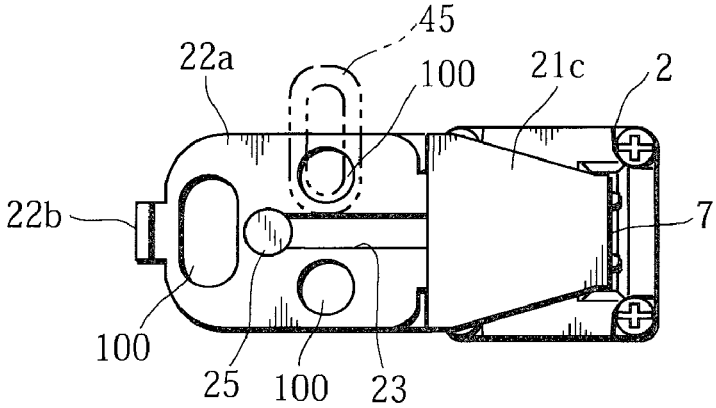
FIG. 27 is a plan view showing a state where the slide body of the safety holder is inserted in the safety switch.
Figure 28:
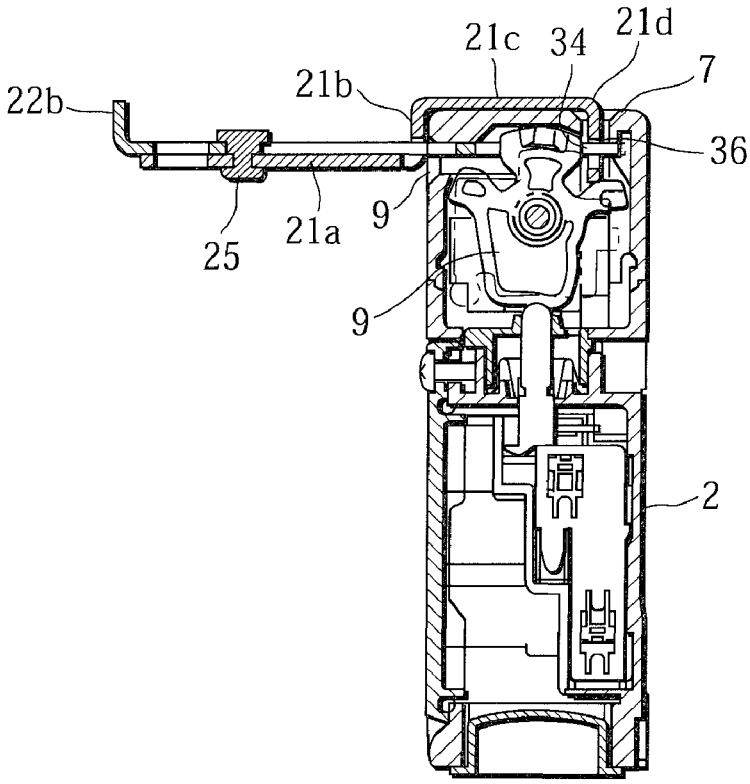
FIG. 28 is a longitudinal cross-sectional view of FIG. 26.
Figure 29:
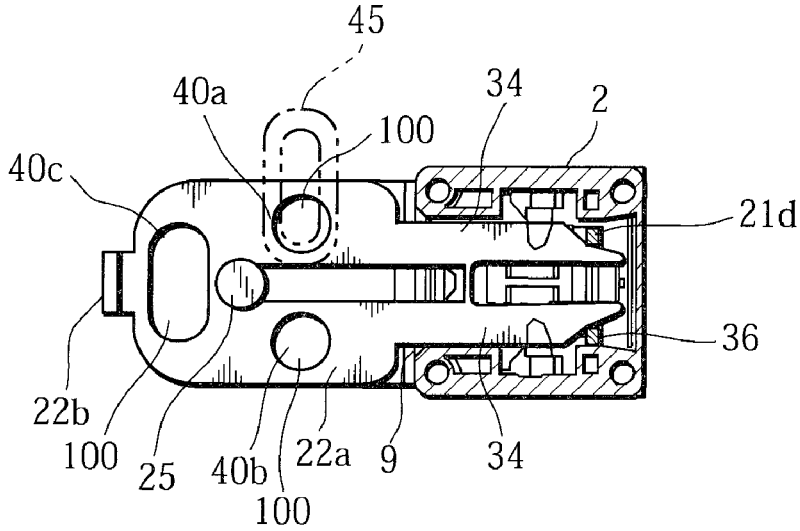
FIG. 29 is a transverse cross-sectional view of FIG. 26.
Figure 30:
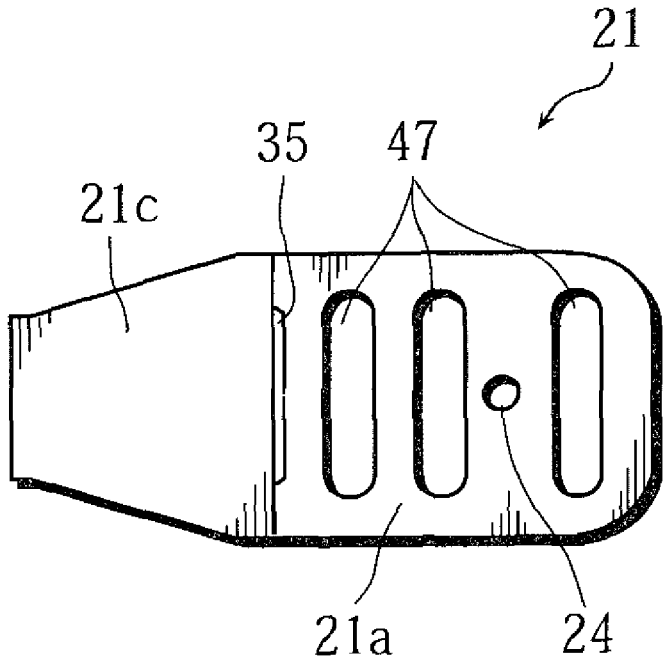
FIG. 30 is a plan view showing a state where the base body is formed with lock mounting openings and the slide body is formed with lock mounting notches.
Figure 30:
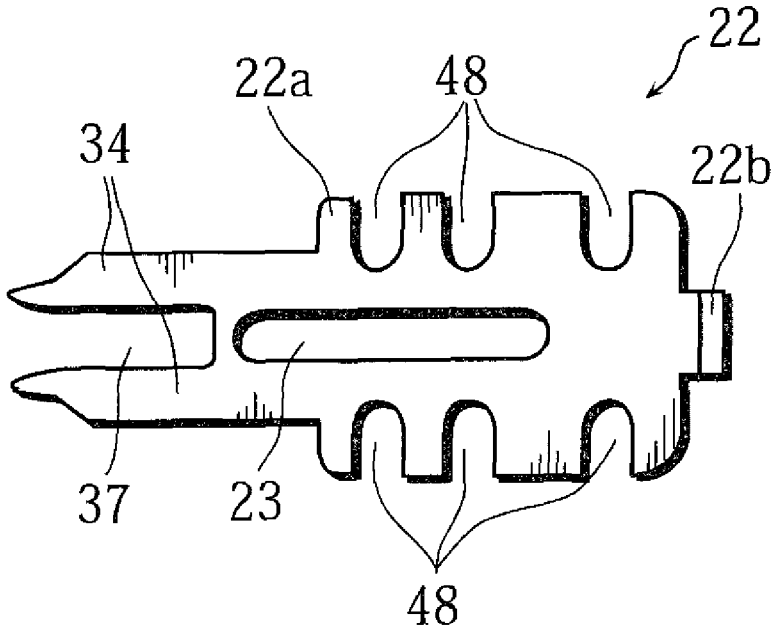
Figure 31:
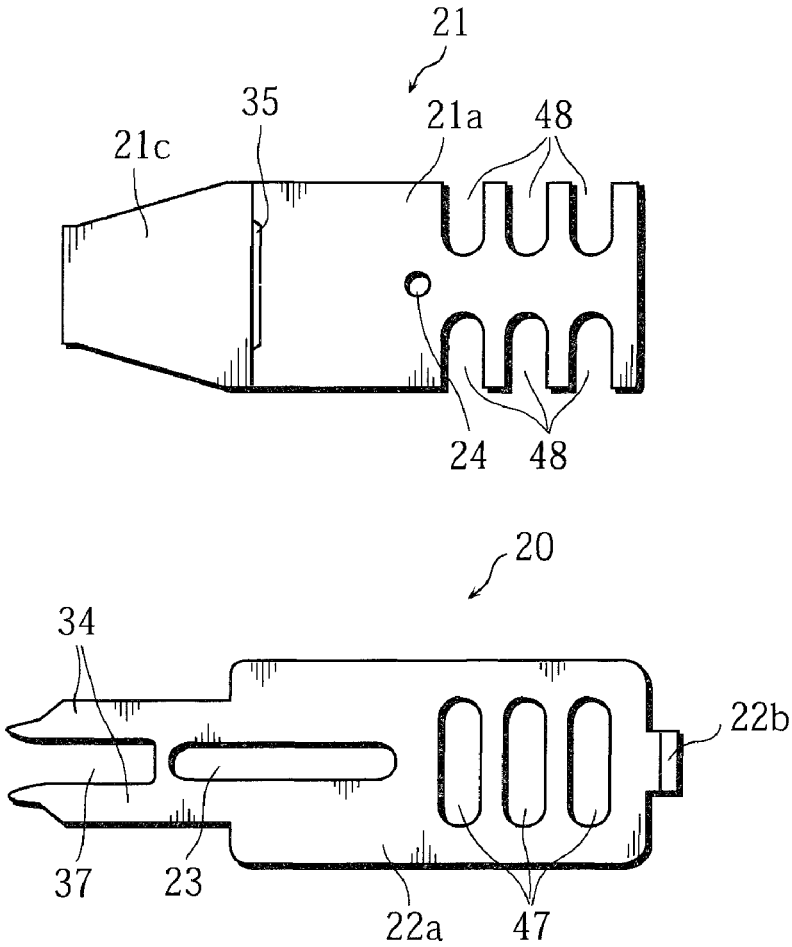
FIG. 31 is a plane view showing a state where the base body is formed with lock mounting notches and the slide body is formed with lock mounting openings.
Figure 32:
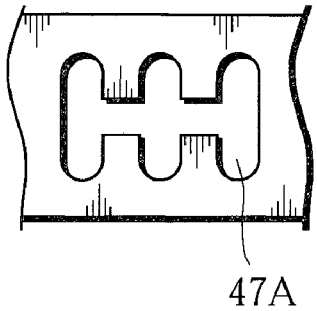
FIG. 32 is a plane view showing variation of a lock mounting opening.
Figure 33:
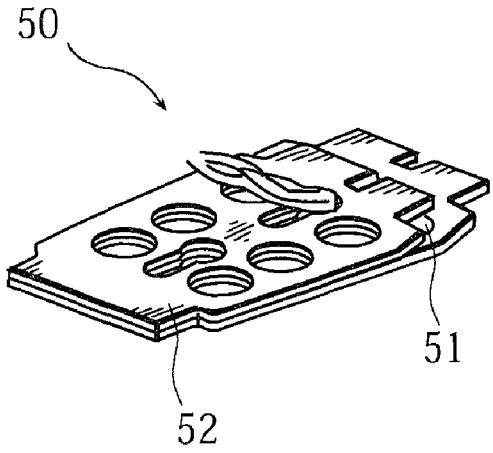
FIG. 33 Prior Art
FIG. 33 is a perspective view of a safety holder as an example of prior art.
Figure 34:
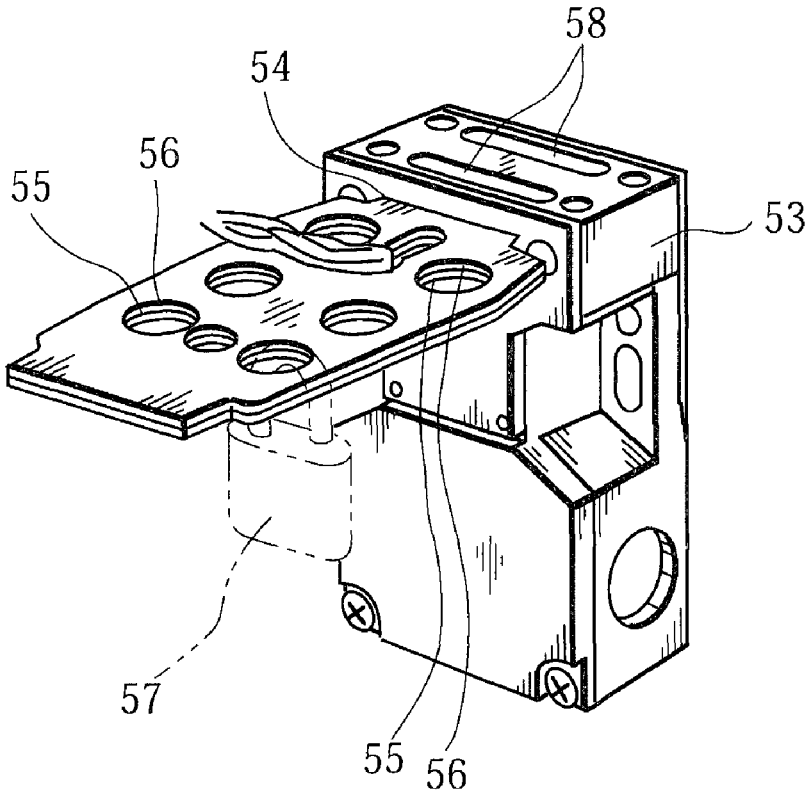
FIG. 34 Prior Art
FIG. 34 is a perspective view showing a state where the safety holder as an example of prior art is mounted on the safety switch.

1: safety switch
2: switch body
7, 8: actuator insertion opening
9: drive cam 9
10: operating rod
12,13: concave portion
20: safety holder
21: main body
21*a*: first flat portion
21*b*: elevating portion
21*c*: second flat portion
21*d*: hanging portion
22: slide body
22*a*: main body portion
22*b*: knob portion
23: guide opening
25: connecting shaft
30*a*, 30*b*, 30*c*; 40*a*, 40*b*, 40*c*, 47, 47A: lock mounting opening
34: insertion arm
35: opening
36: engagement hole
45: pad lock
48: lock mounting notch
X: insertion direction of slide body
100: key hole

The invention claimed is:

1. An assembly having a safety switch and a safety holder for preventing insertion of an actuator into said safety switch, comprising:

said safety switch including a switch body having a box-shaped body and actuator insertion openings provided in two different surfaces thereof through which the actuator is insertable, and a contacting portion provided within the switch body, connection of which is switched in response to the insertion of the actuator, said safety holder including:

a base body that engages with one of the actuator insertion openings provided in the two different surfaces and blocks the one of the actuator insertion openings; and a slide body movably attached to the base body so as to be able to block, when the base body is engaged with the one of the actuator insertion openings, the other one of the actuator insertion openings provided in the two different surfaces by engaging with the other actuator insertion opening.

2. The assembly as set forth in claim 1, wherein a key hole that is formed by the base body and the slide body and for fixing the slide body emerges only when the slide body is moved to a predetermined position at which the slide body blocks the other actuator insertion opening.

3. The assembly as set forth in claim 1 or 2, wherein the slide body is movably and rotatably attached to the base body, and the base body is provided with a rotation limiting means for limiting rotation of the slide body when the slide body is pulled out.

4. The assembly as set forth in claim 1, wherein said safety switch includes a drive member configured to be moved by an actuator to turn on said switch and wherein a tip end portion of the base body inserted into the one of the actuator insertion openings is fitted within the switch body and limits movement of the drive member.

5. The assembly as set forth in claim 4, wherein said safety switch includes a drive cam configured to be rotated by an actuator to turn on said switch and wherein said tip end portion of the base body inserted into the one of the actuator insertion openings is fitted into a concave portion of said drive cam provided within the switch body to thereby limit rotation of the drive cam.

6. The assembly as set forth in claim 1, wherein said safety switch includes an operating member that is moved by insertion of an actuator so that a circuit connection is established via said contacting portion provided within the switch body.

7. The assembly as set forth in claim 6, wherein said operating member is an operating rod that is moved by insertion of an actuator so that a circuit connection is established via said contacting portion provided within the switch body.

8. The assembly as set forth in claim 7, wherein said operating rod is moved via a drive member by insertion of an actuator so that a circuit connection is established via said contacting portion provided within the switch body.

9. The assembly as set forth in claim 8, wherein said drive member is a drive came that is moved by insertion of an actuator so that a circuit connection is established via said contacting portion provided within the switch body.

10. The assembly as set forth in claim 1, wherein when a circuit connection is established via said contacting portion provided within the switch body a circuit connection is established for industrial machines so that the industrial machines become operable.

11. The assembly as set forth in claim 1, wherein said switch body is installed in a vicinity of a door within a room having machines and wherein an actuator is fixed to said door in a manner to engage with said switch body such that machines within said room become operable based on engagement of said actuator fixed to said door with said switch body.

12. The assembly as set forth in claim 1, wherein said switch body is attached to a surface of a doorway having industrial machines and said safety holder stops power supply from being provided to said industrial machines when the doorway is open.

13. A safety holder for preventing insertion of an actuator into a safety switch, the safety switch including a switch body having a box-shaped body and actuator insertion openings provided in two different surfaces thereof through which the actuator is insertable, and a contacting portion provided within the switch body, connection of which is switched in response to the insertion of the actuator, the safety holder characterized by comprising:

a base body that engages with one of the actuator insertion openings provided in the two different surfaces and blocks the one of the actuator insertion openings; and a slide body movably attached to the base body so as to be able to block, when the base body is engaged with the one of the actuator insertion openings, the other one of the actuator insertion openings provided in the two different surfaces by engaging with the other actuator insertion opening;

wherein a tip end portion of the slide body engages with a tip end portion of the base body engaging with the one of the actuator insertion openings when the slide body is engaged with the other actuator insertion opening.

14. A safety holder for preventing insertion of an actuator into a safety switch, the safety switch including a switch body having a box-shaped body and actuator insertion openings provided in two different surfaces thereof through which the actuator is insertable, and a contacting portion provided within the switch body, connection of which is switched in response to the insertion of the actuator, the safety holder characterized by comprising:

a base body that engages with one of the actuator insertion openings provided in the two different surfaces and blocks the one of the actuator insertion openings; and a slide body movably attached to the base body so as to be able to block, when the base body is engaged with the one of the actuator insertion openings, the other one of the actuator insertion openings provided in the two different surfaces by engaging with the other actuator insertion opening;

wherein a tip end portion of the base body inserted into the one of the actuator insertion openings is fitted within the switch body and limits rotation movement of a drive member within the switch body.

15. The safety holder as set forth in claim 14, wherein said tip end portion of the base body inserted into the one of the actuator insertion openings is fitted into a concave portion of a drive cam provided within the switch body to thereby limit rotation of the drive cam.

* * * * *